US009865158B2

(12) United States Patent
Kang et al.

(10) Patent No.: US 9,865,158 B2
(45) Date of Patent: Jan. 9, 2018

(54) METHOD FOR DETECTING FALSE ALARM

(71) Applicant: SAMSUNG SDS CO., LTD., Seoul (KR)

(72) Inventors: Ji-Hoon Kang, Seoul (KR); Soon-Mok Kwon, Seoul (KR); Dong-Ho Yoo, Seoul (KR); Seong-Mi Park, Seoul (KR)

(73) Assignee: SAMSUNG SDS CO., LTD., Seoul (KR)

( * ) Notice: Subject to any disclaimer, the term of this patent is extended or adjusted under 35 U.S.C. 154(b) by 0 days.

(21) Appl. No.: 15/083,565

(22) Filed: Mar. 29, 2016

(65) Prior Publication Data

US 2017/0124855 A1 May 4, 2017

(30) Foreign Application Priority Data

Oct. 30, 2015 (KR) ..... 10-2015-0151811

(51) Int. Cl.
*G08B 29/18* (2006.01)

(52) U.S. Cl.
CPC ..... *G08B 29/185* (2013.01)

(58) Field of Classification Search
CPC ..... G08B 29/185; G05B 23/0235; G05B 23/0259; G05B 23/0263
USPC ..... 340/506, 587, 588, 589; 702/182, 185; 709/220, 223
See application file for complete search history.

(56) References Cited

U.S. PATENT DOCUMENTS 6,351,723 B1 * 2/2002 Maekawa ..... G05B 23/0221 702/179
7,079,984 B2 * 7/2006 Eryurek ..... G05B 23/0289 700/1
7,143,153 B1 * 11/2006 Black ..... H04L 41/0681 709/220
7,589,624 B2 * 9/2009 Hatakeyama ..... G08B 13/2402 340/13.26
8,688,405 B2 * 4/2014 Cottrell ..... G06K 7/10009 340/500
9,251,682 B2 * 2/2016 Knoop ..... G01K 1/026
2006/0074599 A1 * 4/2006 Emigholz ..... C10G 11/187 702/185

FOREIGN PATENT DOCUMENTS

KR 10-2017-0030201 A 3/2017

OTHER PUBLICATIONS

Kim et al., "A Study of Data Mining Methodology for Effective Analysis of False Alarm Event on Mechanical Security System", May 2012, vol. 12, No. 2 (10 pages total).

* cited by examiner

*Primary Examiner* — Hung T Nguyen
(74) *Attorney, Agent, or Firm* — Sughrue Mion, PLLC

(57) ABSTRACT

Disclosed is a method for detecting false alarm. The method includes receiving a measured value that is measured when an alarm is generated from a target for monitoring, measuring non-similarity between the measured value that is measured when the alarm is generated and a pre-stored normal pattern, measuring non-similarity between the measured value and pre-stored measured values related to a past false alarm if the non-similarity exceeds a predetermined threshold value and providing the generated alarm to a user if the non-similarity between the measure value and the pre-stored related values related to the past false alarm exceeds the predetermined threshold value.

22 Claims, 6 Drawing Sheets

[Fig. 1]
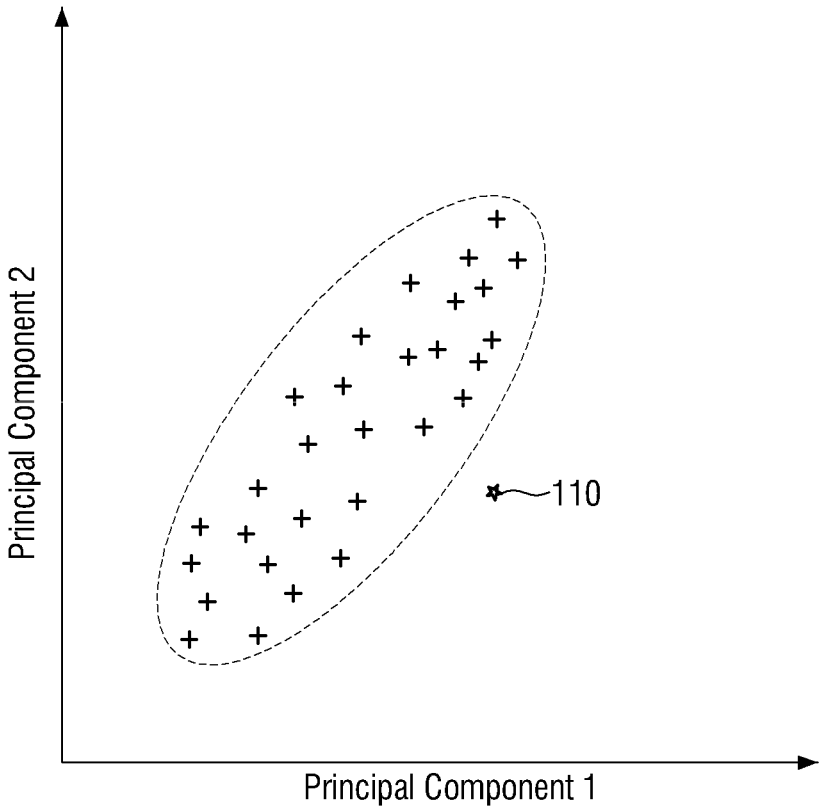

[Fig. 2]
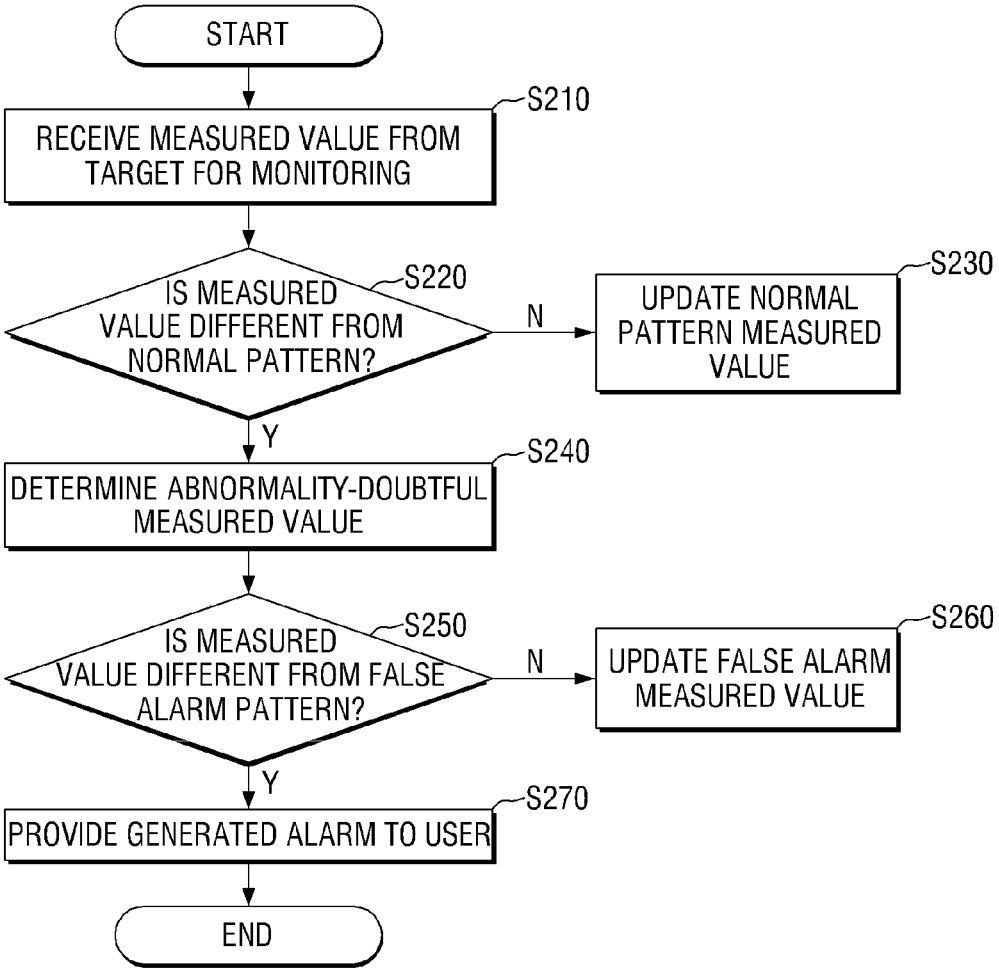

[Fig. 3]
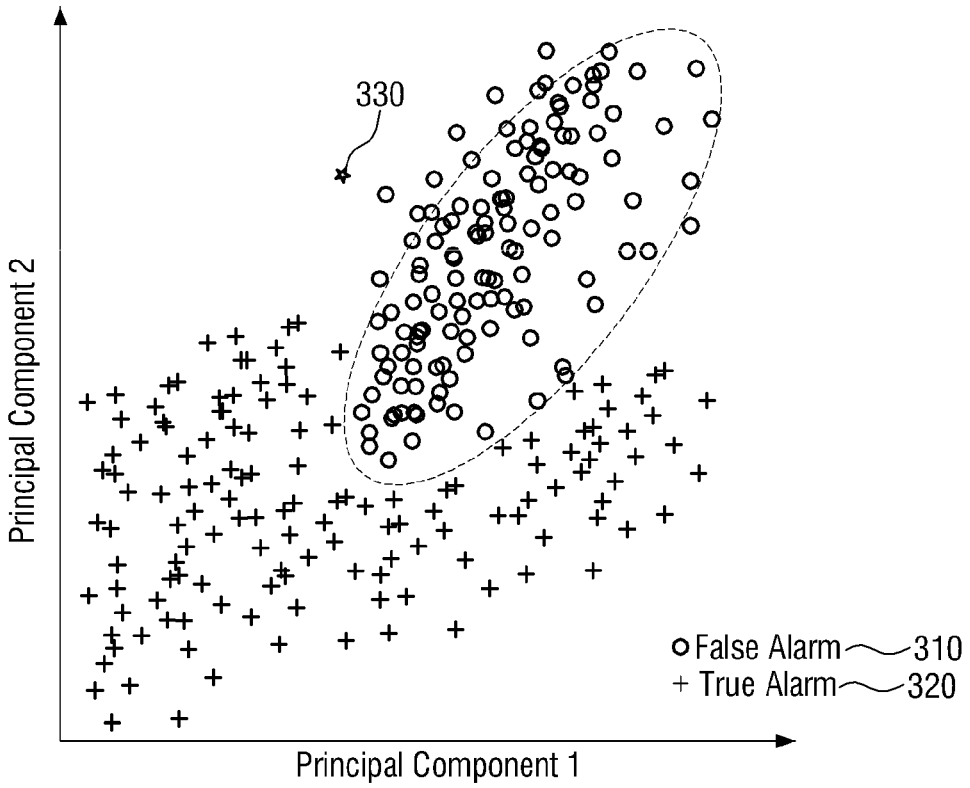

[Fig. 4]
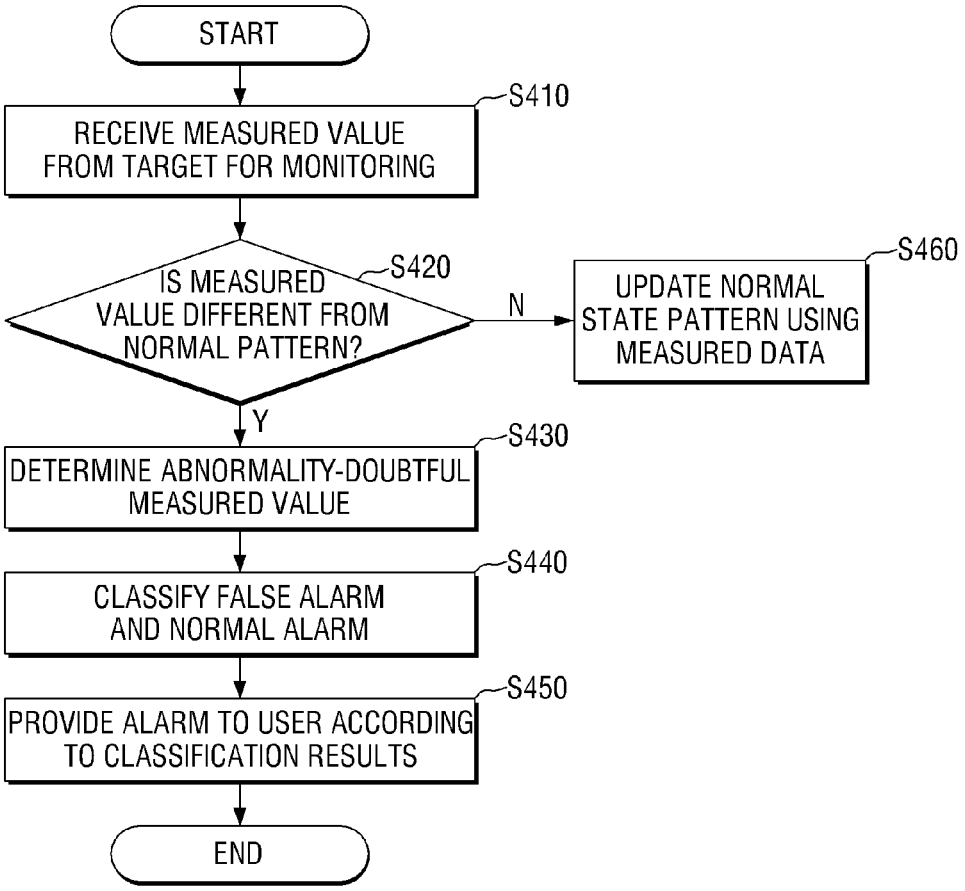
[Fig. 5]
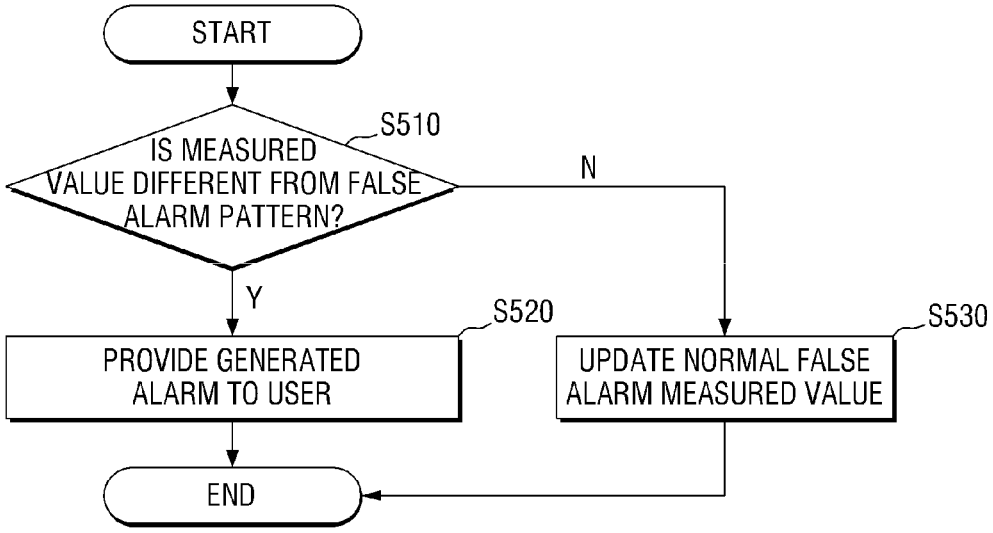

[Fig. 6]
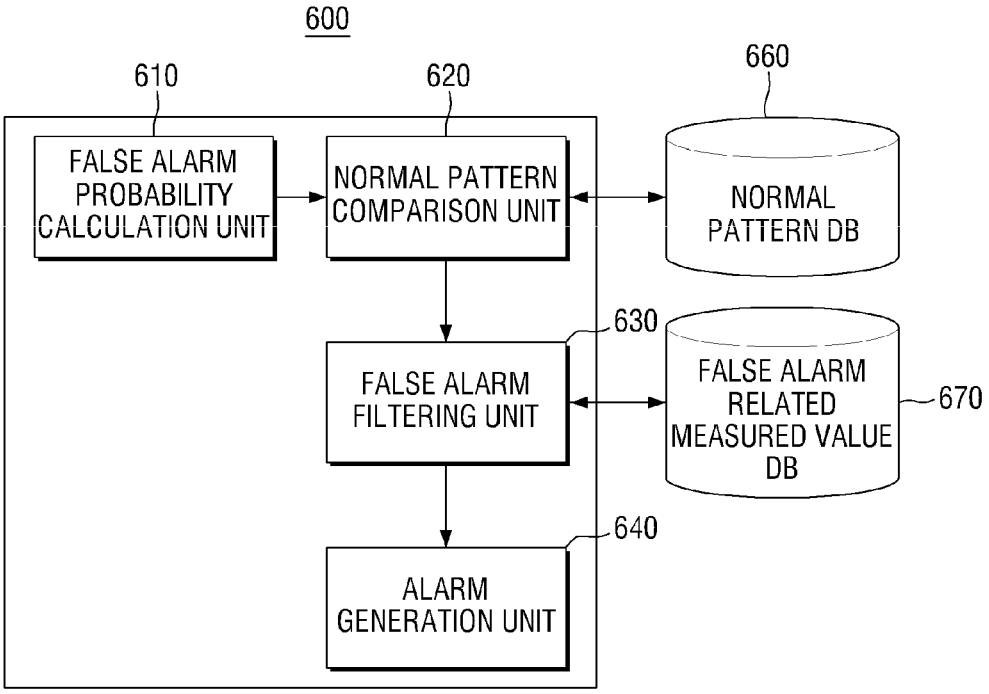
[Fig. 7]
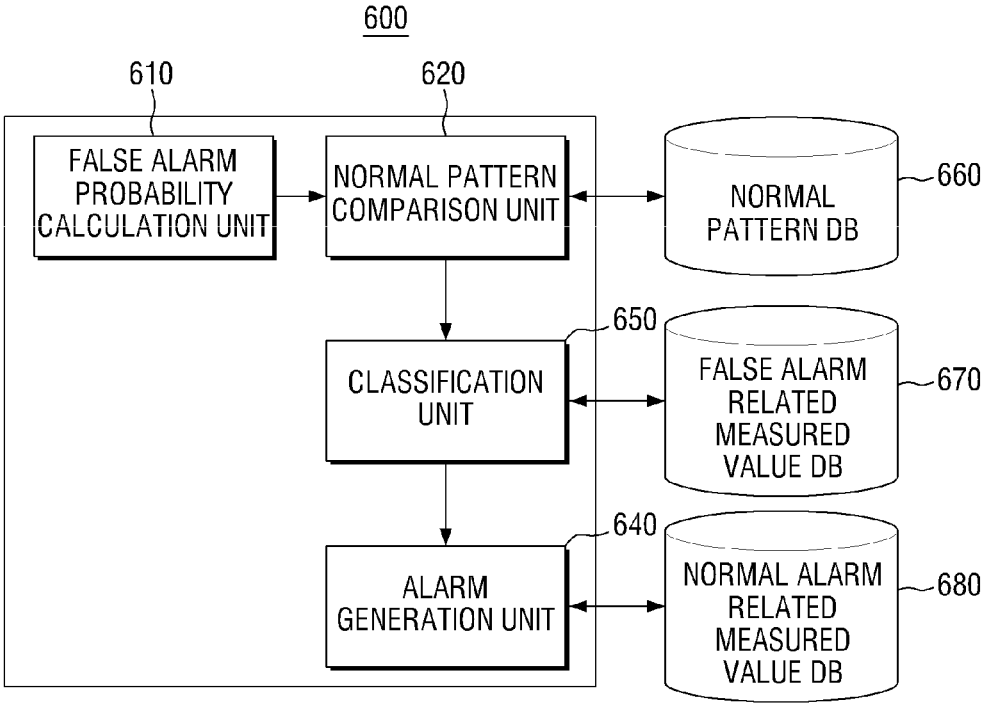

[Fig. 8]
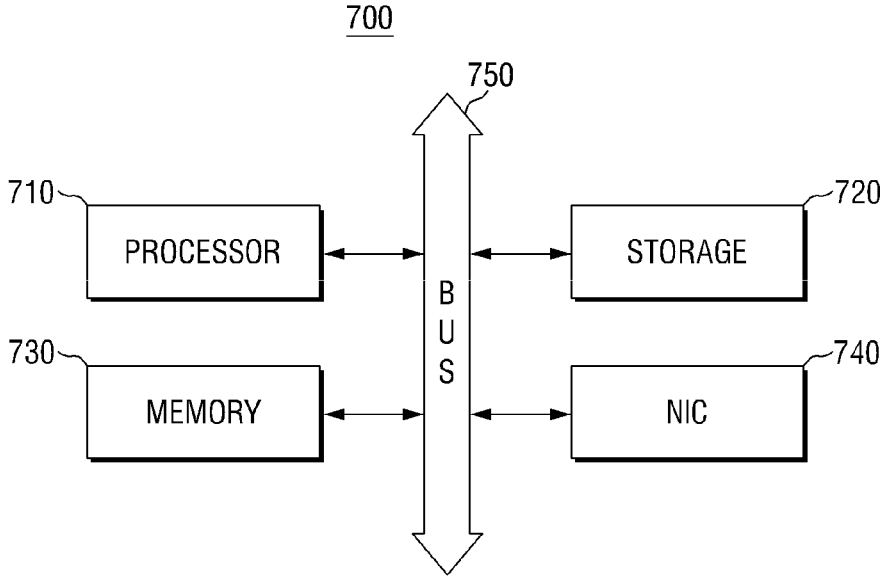

METHOD FOR DETECTING FALSE ALARM

CROSS-REFERENCE TO RELATED APPLICATIONS

This application claims priority from Korean Patent Application No. 10-2015-0151811, filed on Oct. 30, 2015 in the Korean Intellectual Property Office, the disclosure of which is incorporated herein in its entirety by reference.

BACKGROUND

1. Field of the Invention

The present invention relates to a method for detecting a false alarm. More particularly, the present invention relates to a method for detecting a false alarm, which can detect a false alarm through a statistical analysis between pre-stored past data and currently measured data.

2. Description of the Prior Art

An anomaly detection system is a system which detects abnormality through monitoring of a processing state, the quality of a processed product, and the condition of equipment, and intercepts dangerous elements in advance.

As the most representatively utilized technique, a control chart is a technique which detects an inferiority phenomenon in early stages through real time monitoring of processing elements, and takes an appropriate measure so as to continue a normal management of the processing.

One of the largest problems of such existing statistical hypothesis test based methodologies is that they are vulnerable to a false alarm. Here, the false alarm means that an alarm is generated although the processing is in a normal state.

Frequently generated false alarms may cause inconvenience to users of the anomaly detection system, and increase management costs at a production spot to finally deteriorate reliability of the anomaly detection system itself.

The false alarm may be generated ①due to the problem of management limit setting that is caused by the fact that actual data does not follow a normal distribution although the anomaly detection system is designed on the assumption of such a normal distribution, or ②due to the limit of monitoring statistic that is unable to properly consider the characteristics of measured values that are changed in various forms, such as data nonlinearity, temporal variability, multi-normality, and multi-abnormality.

Accordingly, there is a need for a method capable of improving monitoring accuracy through alarm feedback learning in the anomaly detection field.

SUMMARY

Accordingly, the present invention has been made to solve the above-mentioned problems occurring in the prior art, and one subject to be solved by the present invention is to provide a method for detecting a false alarm, which can improve accuracy of monitoring statistic and can efficiently reduce the false alarm.

Additional advantages, subjects, and features of the invention will be set forth in part in the description which follows and in part will become apparent to those having ordinary skill in the art upon examination of the following or may be learned from practice of the invention.

According to an aspect of the present invention, there is provided a method for detecting false alarm, the method comprising receiving a measured value that is measured when an alarm is generated from a target for monitoring, measuring non-similarity between the measured value that is measured when the alarm is generated and a pre-stored normal pattern, measuring non-similarity between the measured value and pre-stored measured values related to a past false alarm if the non-similarity exceeds a predetermined threshold value and providing the generated alarm to a user if the non-similarity between the measure value and the pre-stored related values related to the past false alarm exceeds the predetermined threshold value.

In an embodiment of the present invention, wherein the measuring non-similarity between the measured value and the pre-stored normal pattern comprises updating the pre-stored normal pattern with the measured value that is measured when the alarm is generated if the non-similarity between the measure value and the pre-stored normal pattern is equal to or smaller than the predetermined threshold value.

In an embodiment of the present invention, wherein the measuring non-similarity between the measured value and the pre-stored measured values related to the past false alarm comprises, generating a statistical pattern of the pre-stored measured values related to the past false alarm, measuring a statistical distance between the statistical pattern and the measured value that is measured when the alarm is generated and determining that the measured value that is measured when the alarm is generated is non-similar to the pre-stored measured values related to the past false alarm if the statistical distance is equal to or smaller than a predetermined threshold value.

In an embodiment of the present invention, further comprising updating the pre-stored measured values related to the past false alarm if the non-similarity between the measured value that is measured when the alarm is generated and the pre-stored measured values related to the past false alarm is equal to or smaller than the predetermined threshold value.

In an embodiment of the present invention, wherein the updating the pre-stored measured values related to the past false alarm comprises updating the pre-stored measured values related to the past false alarm by reflecting the measured value that is measured when the alarm is generated in the pre-stored measured values related to the past false alarm.

In an embodiment of the present invention, wherein the measuring the non-similarity between the measured value that is measured when the alarm is generated and the pre-stored normal pattern comprises, calculating a probability that the generated alarm is a false alarm and measuring the non-similarity between the measured value that is measured when the alarm is generated and the pre-stored normal pattern if the probability that the alarm is the false alarm exceeds a predetermined threshold value.

According to another aspect of the present invention, there is provided a method for detect a false alarm, the method comprising receiving a measured value that is measured when an alarm is generated from a target for monitoring, measuring non-similarity between the measured value that is measured when the alarm is generated and a pre-stored normal pattern, classifying the measured value into pre-stored measured values related to a past false alarm or pre-stored measured values related to a past normal alarm if the non-similarity exceeds a predetermined threshold value and providing the alarm to a user if the measured value that is measured when the alarm is generated is classified into the pre-stored measured values related to the past normal alarm.

In an embodiment of the present invention, wherein the measuring non-similarity between the measured value and the pre-stored normal pattern comprises updating the pre-stored normal pattern with the measured value that is measured when the alarm is generated if the non-similarity between the measure value and the pre-stored normal pattern is equal to or smaller than the predetermined threshold value.

In an embodiment of the present invention, wherein the classifying the measured value into the pre-stored measured values related to the past false alarm or the pre-stored measured values related to the past normal alarm comprises, generating a first statistical pattern that is a statistical pattern of the pre-stored measured values related to the past false alarm and a second statistical pattern that is a statistical pattern of the pre-stored measured values related to the past normal alarm, measuring a statistical distance between the measured value that is measured when the alarm is generated and the first statistical pattern and a statistical distance between the measured value that is measured when the alarm is generated and the second statistical pattern and classifying the measured value that is measured when the alarm is generated so that the measured value belongs to the first statistical pattern or the second statistical pattern in accordance with the measured statistical distance.

In an embodiment of the present invention, further comprising updating the pre-stored measured values related to the past false alarm if the non-similarity between the measured value that is measured when the alarm is generated and the pre-stored measured values related to the past false alarm is equal to or smaller than the predetermined threshold value.

In an embodiment of the present invention, wherein the updating the pre-stored measured values related to the past false alarm comprises updating the pre-stored measured values related to the past false alarm by reflecting the measured value that is measured when the alarm is generated in the pre-stored measured values related to the past false alarm.

In an embodiment of the present invention, wherein the measuring the non-similarity between the measured value that is measured when the alarm is generated and the pre-stored normal pattern comprises, calculating a probability that the generated alarm is a false alarm and measuring the non-similarity between the measured value that is measured when the alarm is generated and the pre-stored normal pattern if the probability that the alarm is the false alarm exceeds a predetermined threshold value.

According to another aspect of the present invention, there is provided a false alarm detecting apparatus comprising a normal pattern comparison unit configured to measure non-similarity between a measured value that is measured when an alarm is generated in a target for monitoring and a pre-stored normal pattern, a false alarm filtering unit configured to measure non-similarity between the measured value and pre-stored measured values related to a past false alarm if the non-similarity exceeds a predetermined threshold value and an alarm generation unit configured to provide the generated alarm to a user if the non-similarity between the measure value and the pre-stored related values related to the past false alarm exceeds a predetermined threshold value.

In an embodiment of the present invention, wherein the normal pattern comparison unit updates the pre-stored normal pattern with the measured value that is measured when the alarm is generated if the non-similarity between the measure value and the pre-stored normal pattern is equal to or smaller than the predetermined threshold value.

In an embodiment of the present invention, wherein the false information filtering unit measures a statistical distance between a statistical pattern of the pre-stored measured values related to the past false alarm and the measured values measured when the alarm is generated, and determines that the measured value that is measured when the alarm is generated is non-similar to the pre-stored measured values related to the past false alarm if the statistical distance is equal to or smaller than a predetermined threshold value.

In an embodiment of the present invention, wherein the false alarm filtering unit updates the pre-stored measured values related to the past false alarm if the non-similarity between the measured value that is measured when the alarm is generated and the pre-stored measured values related to the past false alarm is equal to or smaller than the predetermined threshold value.

In an embodiment of the present invention, further comprising a false alarm probability calculation unit configured to calculate a probability that the generated alarm is a false alarm, wherein the normal pattern comparison unit measures the non-similarity between the measured value that is measured when the alarm is generated and the pre-stored normal pattern if the probability that the alarm is the false alarm exceeds a predetermined threshold value.

According to another aspect of the present invention, there is provided a false alarm detecting apparatus comprising a normal pattern comparison unit configured to measure non-similarity between a measured value that is measured when an alarm is generated in a target for monitoring and a pre-stored normal pattern, a classification unit configured to classify the measured value into pre-stored measured values related to a past false alarm or pre-stored measured values related to a past normal alarm if the non-similarity exceeds a predetermined threshold value and an alarm generation unit configured to provide the alarm to a user if the measured value that is measured when the alarm is generated is classified into the pre-stored measured values related to the past normal alarm.

In an embodiment of the present invention, wherein the normal pattern comparison unit updates the pre-stored normal pattern with the measured value that is measured when the alarm is generated if the non-similarity between the measure value and the pre-stored normal pattern is equal to or smaller than the predetermined threshold value.

In an embodiment of the present invention, wherein the classification unit measures a statistical distance between the measured value that is measured when the alarm is generated and the first statistical pattern and a statistical distance between the measured value that is measured when the alarm is generated and the second statistical pattern, and classifies the measured value that is measured when the alarm is generated so that the measured value belongs to the first statistical pattern or the second statistical pattern in accordance with the measured statistical distance.

In an embodiment of the present invention, wherein the classification unit updates the pre-stored measured values related to the past false alarm if the non-similarity between the measured value that is measured when the alarm is generated and the pre-stored measured values related to the past false alarm is equal to or smaller than the predetermined threshold value.

In an embodiment of the present invention, the false alarm detecting apparatus further comprising a false alarm probability calculation unit configured to calculate a probability that the generated alarm is a false alarm, wherein the normal pattern comparison unit measures the non-similarity between the measured value that is measured when the alarm is generated and the pre-stored normal pattern if the probability that the alarm is the false alarm exceeds a predetermined threshold value.

BRIEF DESCRIPTION OF THE DRAWINGS

The above and other objects, features and advantages of the present invention will be more apparent from the following detailed description taken in conjunction with the accompanying drawings, in which:

FIG. 1 is a diagram explaining pre-stored false alarm measured values according to an embodiment of the present invention;

FIG. 2 is a flowchart explaining a method for detecting a false alarm according to an embodiment of the present invention;

FIG. 3 is a diagram explaining a process of detecting a false alarm according to another embodiment of the present invention;

FIG. 4 is a flowchart explaining a method for detecting a false alarm through the process explained with reference to FIG. 3;

FIG. 5 is a diagram explaining a process of updating pre-stored measured value data with newly collected data according to an embodiment of the present invention;

FIG. 6 is a block diagram explaining an apparatus for detecting a false alarm according to an embodiment of the present invention;

FIG. 7 is a functional block diagram explaining an apparatus for detecting a false alarm according to another embodiment of the present invention; and FIG. 8 is a functional block diagram explaining an apparatus for detecting a false alarm according to still another embodiment of the present invention.

DETAILED DESCRIPTION OF THE EMBODIMENTS

Advantages and features of the present invention and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like numbers refer to like elements throughout.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In addition, it will be understood that the singular forms are intended to include the plural forms as well. It will be further understood that the terms "comprises" and/or "comprising," when used in this specification, specify the presence of stated features, integers, steps, operations, elements, and/or components, but do not preclude the presence or addition of one or more other features, operations, elements, and/or components thereof.

Hereinafter, preferred embodiments of the present invention will be described in detail with reference to the accompanying drawings.

FIG. 1 is a diagram explaining pre-stored false alarm measured values according to an embodiment of the present invention.

The graph illustrated in FIG. 1 shows measured values that were measured when a past false alarm was generated. In an embodiment of the present invention, in the case where a target for monitoring is a machinery facility, x-axis of the graph illustrated in FIG. 1 may represent temperature of the machinery facility, and y-axis may represent pressure.

As illustrated in FIG. 1, the measured values that are measured when a false alarm is generated show a specific statistical pattern, and thus it becomes possible to detect whether the currently generated alarm is a false alarm through comparison of the currently measured value with pre-stored past data.

For example, if the currently measured value 110 is as illustrated in FIG. 1, it is possible to detect whether the currently measured value 110 is the measured value that is measured when the false alarm is generated through measurement of the statistical pattern and the statistical distance of the past measured values.

If the statistical distance that is measured through the above-described process is equal to or smaller than a predetermined threshold value, it may be determined that the measured value that is measured when the alarm is generated is similar to the pre-stored measured values related to the past false alarm. Accordingly, it may be determined that the currently generated alarm is the false alarm.

In contrast, if the statistical distance between the currently measured value 110 and the pre-stored measured values related to the past false alarm exceeds the predetermined threshold value, it may be determined that the currently measured value 110 is non-similar to the measured values related to the past false alarm. Accordingly, it may be determined that the currently generated alarm is a normal alarm.

In this embodiment, it is exemplified that the statistical distance between the currently measured value and the measured values measured when the past false alarm was generated is measured, but the present invention is not limited thereto. The present invention may be implemented to measure the statistical distance between the currently measured value and the measured values measured when the past normal alarm was generated.

Hereinafter, a process of detecting whether the currently generated alarm is the false alarm through comparison of the currently measured value with the pre-stored measured values measured when the past false alarm was generated will be described.

FIG. 2 is a flowchart explaining a method for detecting a false alarm according to an embodiment of the present invention.

Hereinafter, it is exemplified that the target for monitoring is a production process or a machinery facility. However, the target for monitoring is not limited thereto, but may be various fields related to health care, marketing results, and fraudulent practices.

Further, a process of discriminating whether an alarm that is generated through sensing of abnormality of the target for monitoring is a false alarm or a normal alarm will be described in detail.

A measured value is received from the target for monitoring (S210). Then, it is determined whether the measured value that is measured when the alarm is generated is non-similar to a normal pattern (S220).

Here, the normal pattern means a pattern of the measured values that are measured when the target for monitoring is in a normal operation state. Accordingly, by measuring non-similarity between the currently measured value and pre-stored normal pattern data, it can be determined whether any problem occurs in the target for monitoring.

If it is determined that the measured value is different from the normal pattern, that is, if the measured non-similarity exceeds a predetermined threshold value, it is determined that the measured value is abnormal (S240).

In contrast, if it is determined that the measured value is similar to the normal pattern, that is, the measured non-similarity is equal to or smaller than the predetermined threshold value, the normal pattern measured value is updated with the measured value (S230).

If it is determined that the currently measured value is abnormal, the non-similarity between the currently measured value and the measured value measured when the past false alarm was generated is determined (S250).

For this, the apparatus for detecting a false alarm according to an embodiment of the present invention may pre-store data related to false alarms generated in the past. For example, the apparatus may pre-store data related to the temperature and the pressure of a machinery facility that were measured when the past false alarms were generated.

In the case of measuring the non-similarity between the currently measured value and the pre-stored measured values related to the past false alarm, a method for measuring a statistical distance, a method for measuring a monitoring statistic of a general control chart, or a novelty score method through a one-class classification algorithm may be used as a calculation method, but is not limited thereto. Other general-purpose technologies may be used instead.

If it is determined that the currently measured value is non-similar to the pre-stored measured values related to the past false alarm, that is, if the non-similarity exceeds the predetermined threshold value, it is determined that the currently generated alarm is not a false alarm, and the generated alarm is provided to a user (S270).

In contrast, if it is determined that the currently measured value is similar to the pre-stored measured values related to the past false alarm, that is, if it is determined that the currently generated alarm is a false alarm, the generated alarm is not provided to the user, and the pre-stored measured values are updated using the currently measured value (S260).

On the other hand, the method for detecting a false alarm according to an embodiment of the present invention may pre-calculate a probability that the generated alarm is a false alarm when the alarm is generated.

Specifically, if abnormality is sensed in the production process or the machinery facility and an alarm is generated, the probability that the generated alarm is a false alarm is calculated. In this case, a method for calculating the probability that the generated alarm is a false alarm may be calculated using data, such as time when the corresponding machinery facility was inspected and time when the corresponding machinery facility was actually troubled.

However, the detailed method for calculating the probability that the generated alarm is a false alarm is not limited thereto, but may be implemented to calculate the probability that the generated alarm is a false alarm in other general-purpose methods.

Only in the case where the probability that the generated alarm is a false alarm that is calculated through the above-described process exceeds a predetermined threshold value, a step of comparing the measured value measured when the alarm is generated with a pre-stored normal pattern measured value may be performed to determine whether the generated alarm is actually a false alarm or a normal alarm.

According to the above-described method for detecting a false alarm, the false alarm that is generated due to the statistical hypothesis test limit can be effectively controlled.

Further, since the measured values related to the false alarms can be continuously updated through a reflexive algorithm, the accuracy can be further increased.

FIG. 3 is a diagram explaining a process of detecting a false alarm according to another embodiment of the present invention.

The graph illustrated in FIG. 3 shows measured values that were measured when a past false alarm was generated and measured values that were measured when a normal alarm was generated. For example, in the case where a target for monitoring is a machinery facility and measured values related to the machinery facility are temperature and pressure, a first identifier 310 may be temperature and pressure values measured when the past false alarm was generated, and a second identifier 320 may be temperature and pressure values measure when the past normal alarm was generated.

As illustrated in FIG. 3, the measured values measured when the normal alarm was generated and the measured values measured when the false alarm was generated may have a specific statistical pattern, Accordingly, by measuring the statistical distance between the currently measured value and a first statistical pattern that is a statistical pattern of the measured values measured when the past false alarm was generated and the statistical distance between the currently measured value and a second statistical pattern that is a statistical pattern of the measured values measured when the past normal alarm was generated, it becomes possible to determine which statistical pattern the currently measured value belongs to.

For example, if it is determined that the currently measured value 330 is statistically close to the first statistical pattern, it may be determined that the currently generated alarm is a false alarm. In contrast, if it is determined that the currently measured value 330 is statistically close to the second statistical pattern, it may be determined that the currently generated alarm is a normal alarm.

That is, since the statistical pattern that is shown by the measured values measured when the past false alarm was generated is different from the statistical pattern that is shown by the measured values measured when the past normal alarm was generated, it becomes possible to determine whether the currently generated alarm is a false alarm or a normal alarm by determining which statistical pattern the measured values are classified into.

FIG. 4 is a flowchart explaining a method for detecting a false alarm through the process explained with reference to FIG. 3.

A measured value that is measured when an alarm is generated is received (S410).

Thereafter, it is determined whether the measured value that is measured when the alarm is generated is non-similar to a normal pattern (S420). If a target for monitoring is a machinery facility according to an embodiment of the present invention, the temperature or pressure of the machinery facility may be the measured value. Further, the normal pattern means a pattern of the measured values that are measured when an event, in which the measured value that is the target for monitoring secedes from a normal category, does not occur.

For this, the apparatus for detecting a false alarm according to an embodiment of the present invention may pre-store various kinds of data measured when the target for monitoring is in a normal operation state.

In the case of detecting whether the measured value is different from the pre-stored normal pattern, a method for measuring a statistical distance, a method for measuring a monitoring statistic of a general control chart, or a novelty score method through a one-class classification algorithm may be used, but is not limited thereto. Other general-purpose technologies may be used instead.

If the non-similarity between the measured value and the pre-stored normal state pattern is equal to or smaller than the predetermined threshold value, the pre-stored normal state pattern is updated using the measured data (S460). That the measured value is not different from the pre-stored normal state pattern means that the current machinery facility is in a normal state, and thus the pre-stored normal state pattern is updated with the currently measured data.

If the measured value is different from the pre-stored normal state pattern, that is, if the non-similarity exceeds the predetermined threshold value, it is determined that the target for monitoring is abnormal (S430).

If it is determined that the measured value is abnormal, the generated alarm is not directly provided to the user, but the measured value is classified into the pre-stored measured value related to the past false alarm and the pre-stored measured value related to the past normal alarm (S440).

For this, the apparatus for detecting a false alarm according to an embodiment of the present invention may pre-store the measured values measured when the past false alarm was generated and the measured values measured when the normal alarm was generated.

That is, it is determined whether the currently generated alarm is a false alarm or a normal alarm by comparing the measured value measured when the alarm was generated with the measured value measured when the past false alarm was generated and the measured value measured when the normal alarm was generated.

For this, the apparatus for detecting a false alarm according to an embodiment of the present invention may determine whether the currently measured value corresponds to the measured value related to the false alarm or the measured value measured when the normal alarm was generated using one of a linear discrimination analysis, a decision tree, a neural network model, a support vector machine, or a K-nearest neighbor algorithm.

Thereafter, if it is determined that the measured value belongs to the measured value measured when the past normal alarm was generated, the apparatus provides the generated alarm to a user (S450).

On the other hand, the method for detecting a false alarm according to an embodiment of the present invention may be implemented to calculate a probability that the generated alarm is a false alarm when the alarm is generated and to perform the above-described method for detecting a false alarm only in the case where the probability that the generated alarm is a false alarm exceeds the predetermined threshold value.

In order to determine whether the currently generated alarm is a false alarm according to the above-described method, the measured values measured when the past false alarm was generated and the measured value measured when the normal alarm was generated should be pre-stored.

Further, by updating the pre-stored measure values with the newly measured data, the measured data can be classified more accurately.

FIG. 5 is a diagram explaining a process of updating pre-stored measured value data with newly collected data according to an embodiment of the present invention.

The pre-stored measured value data may be updated by a newly measured value. Specifically, by reflecting the newly measured value in the pre-stored measured value data, the pre-stored measured value data is reflexively learned. The monitoring technique may become more delicate by the above-described feedback algorithm.

If it is determined that the measured value is different from the pre-stored normal pattern, this is determined as the abnormal measured value, and is compared with the pre-stored false alarm measured value and the normal alarm measured value data.

Specifically, it is determined whether the measured value is different from the pre-stored false alarm pattern (S510). If it is determined that the measured value is different from the pre-stored false alarm pattern, it is determined that the generated alarm is not a false alarm, and the generated alarm may be provided to the user (S520).

In contrast, if it is determined that the measured value is similar to the pre-stored false alarm measured value, the pre-stored false alarm measured value is updated with the newly measured value (S530).

On the other hand, in this embodiment, it is described that only the pre-stored false alarm measured value is updated, but is not limited thereto. The pre-stored normal alarm measured value may also be implemented to be updated in the same manner.

FIG. 6 is a block diagram explaining an apparatus for detecting a false alarm according to an embodiment of the present invention.

An apparatus 600 for detecting a false alarm according to an embodiment of the present invention includes a false alarm probability calculation unit 610, a normal pattern comparison unit 620, a false alarm filtering unit 630, and an alarm generation unit 640.

Further, in this embodiment, it is exemplified that a normal pattern DB 660 for storing normal pattern measured values and a false alarm related measured value DB 670 for storing measured values related to a false alarm generated in the past are configured separately from the apparatus 600 for detecting a false alarm. However, the DBs 660 and 670 may be implemented to be included in the apparatus 600 for detecting a false alarm.

On the other hand, FIG. 6 illustrates only constituent elements related to embodiments of the present invention. Accordingly, those of ordinary skill in the art to which the present invention pertains can be aware that other general-purpose constituent elements may be further included in addition to the constituent elements in FIG. 6.

The false alarm probability calculation unit 610 calculates the probability that the generated alarm is a false alarm.

The normal pattern comparison unit 620 measures the non-similarity between the measured value measured when the alarm is generated and the pre-stored normal pattern if the probability that the measured alarm is a false alarm exceeds the predetermined threshold value.

Further, the normal pattern comparison unit 620 may update the pre-stored normal pattern that is pre-stored in the normal pattern with a newly measured value as described above.

If the non-similarity between the pre-stored normal pattern and the measured value measured when the alarm is generated exceeds the predetermined threshold value, the false alarm filtering unit 630 measures the non-similarity between the measured value and the pre-stored past false alarm related measured values.

For this, the measured values measured when the past false alarm was generated may be stored in the false alarm related measured value DB 670.

The alarm generation unit 640 provides the generated alarm to the user if the non-similarity between the measured value and the pre-stored measured values related to the past false alarm exceeds the predetermined threshold value. That is, if it is determined that the generated alarm is not a false alarm, the alarm generation unit 640 provides the generated alarm to the user.

On the other hand, the apparatus 600 for detecting a false alarm according to an embodiment of the present invention may determine whether the generated alarm is a false alarm through classification of whether the measured values are measured values related to the false alarm or measured values related to the normal alarm.

FIG. 7 is a functional block diagram explaining an apparatus for detecting a false alarm according to another embodiment of the present invention.

An apparatus 600 for detecting a false alarm according to another embodiment of the present invention includes a false alarm probability calculation unit 610, a normal pattern comparison unit 620, an alarm generation unit 640, and a classification unit 650.

Further, as described above with reference to FIG. 6, in this embodiment, it is exemplified that a normal pattern DB 660 for storing normal pattern measured values, a false alarm related measured value DB 670 for storing measured values related to a false alarm generated in the past, and a normal alarm related measured value DB 680 for storing measured values related to a normal alarm generated in the past are configured separately from one another. However, the above-described DBs may be implemented to be included in the apparatus 600 for detecting a false alarm.

Since the false alarm probability calculation unit 610 and the normal pattern comparison unit 620 illustrated in FIG. 7 perform the same functions as those illustrated in FIG. 6, the duplicate explanation thereof will be omitted.

The classification unit 650 classifies the measured values into false alarm related measured values or normal alarm related measured values if it is determined that the measured values measured when the alarm was generated is non-similar to the normal pattern.

For this, the classification unit 650 according to an embodiment of the present invention may measure the statistical distance between the measured value measured when the alarm was generated and a first statistical pattern that is a statistical pattern of the measured values related to the past false alarm pre-stored in the false alarm related measured value DB 670 and the statistical distance between the measured value measured when the alarm was generated and a second statistical pattern that is a statistical pattern of the measured values related to the past normal alarm pre-stored in the normal alarm related measured value DB 680.

Thereafter, if the measured value measured when the alarm was generated is classified into the measured value stored in the normal alarm related measured value DB 680, the alarm generation unit 640 provides the generated alarm to the user.

According to the apparatus 600 for detecting a false alarm as described above, it becomes possible to effectively control the false alarm that is generated due to the statistical hypothesis test limit.

FIG. 8 is a functional block diagram explaining an apparatus for detecting a false alarm according to still another embodiment of the present invention.

An apparatus 700 for detecting a false alarm as illustrated in FIG. 8 includes a processor 710, a storage 720, a memory 730, a network interface 740, and a bus 750.

FIG. 8 illustrates only constituent elements related to embodiments of the present invention. Accordingly, those of ordinary skill in the art to which the present invention pertains can be aware that other general-purpose constituent elements may be further included in addition to the constituent elements in FIG. 8.

The processor 710 executes a program that can detect a false alarm. However, the program that can be executed by the processor 710 is not limited thereto, and other general-purpose programs may be executed.

The storage 720 stores the program that can detect the false alarm. Further, in the storage 720, measured values measured when the target for monitoring operates as a normal pattern, measured values measured when the past false alarm was generated, and measured values measured when the past normal alarm was generated may be stored.

On the other hand, the program that can detect the false alarm may execute receiving a measured value that is measured when an alarm is generated from a target for monitoring, measuring non-similarity between the measured value that is measured when the alarm is generated and a pre-stored normal pattern, measuring non-similarity between the measured value and pre-stored measured values related to a past false alarm if the non-similarity exceeds a predetermined threshold value, and providing the generated alarm to a user if the non-similarity between the measure value and the pre-stored related values related to the past false alarm exceeds the predetermined threshold value.

Further, the program that can detect the false alarm may execute receiving a measured value that is measured when an alarm is generated from a target for monitoring, measuring non-similarity between the measured value that is measured when the alarm is generated and a pre-stored normal pattern, classifying the measured value into pre-stored measured values related to a past false alarm or pre-stored measured values related to a past normal alarm if the non-similarity exceeds a predetermined threshold value, and providing the alarm to a user if the measured value that is measured when the alarm is generated is classified into the pre-stored measured values related to the past normal alarm.

The memory 730 loads a false alarm detection program that can be executed by the processor 710.

The network interface can be connected to various computing devices, and the bus 750 serves as a data transfer path to which the processor 710, the storage 720, the memory 730, and the network interface 740 are connected.

The method for detecting false alarm according to the present invention can be recorded in programs that can be executed on a computer and be implemented through general purpose digital computers. In addition, the data format used in the method for generating the web page according to the present invention may be recorded in a computer-readable recording medium using various means. Examples of the computer-readable recording medium may include recording media such as magnetic storage media (e.g., ROMs, floppy disks, hard disks, etc.) and optical recording media (e.g., CD-ROMs or DVDs).

While the present invention has been particularly shown and described with reference to exemplary embodiments thereof, it will be understood by those of ordinary skill in the art that various changes in form and details may be made therein without departing from the spirit and scope of the present invention as defined by the following claims. It is therefore desired that the present embodiments be considered in all respects as illustrative and not restrictive, reference being made to the appended claims rather than the foregoing description to indicate the scope of the invention.

What is claimed is:

1. A method for detecting a false alarm, comprising:

receiving from a target for monitoring a measured value indicating a status of the target that is measured when an alarm is generated;

measuring non-similarity between the measured value that is measured when the alarm is generated and a pre-stored normal pattern indicating normal alarm;

measuring non-similarity between the measured value and a first statistical pattern of pre-stored measured values related to a past false alarm based on a first statistical distance between the measured value and the first statistical pattern if the non-similarity exceeds a first predetermined threshold value; and outputting the generated alarm if the non-similarity between the measure value and the pre-stored values related to the past false alarm exceeds a second predetermined threshold value.

2. The method of claim 1, wherein the measuring non-similarity between the measured value and the pre-stored normal pattern comprises updating the pre-stored normal pattern with the measured value that is measured when the alarm is generated if the non-similarity between the measure value and the pre-stored normal pattern is equal to or smaller than the first predetermined threshold value.

3. The method of claim 1, wherein the measuring non-similarity between the measured value and the first statistical pattern of the pre-stored measured values related to the past false alarm comprises:

generating the first statistical pattern of the pre-stored measured values related to the past false alarm;

measuring the first statistical distance between the statistical pattern and the measured value that is measured when the alarm is generated; and determining that the measured value that is measured when the alarm is generated is non-similar to the first statistical pattern of the pre-stored measured values related to the past false alarm if the first statistical distance is greater than a third predetermined threshold value.

4. The method of claim 1, further comprising updating the pre-stored measured values related to the past false alarm if the non-similarity between the measured value that is measured when the alarm is generated and the first statistical pattern is equal to or smaller than the second predetermined threshold value.

5. The method of claim 4, wherein the updating the pre-stored measured values related to the past false alarm comprises updating the pre-stored measured values related to the past false alarm by reflecting the measured value that is measured when the alarm is generated in the pre-stored measured values related to the past false alarm.

6. The method of claim 1, wherein the measuring the non-similarity between the measured value that is measured when the alarm is generated and the pre-stored normal pattern comprises:

calculating a probability that the generated alarm is a false alarm; and measuring the non-similarity between the measured value that is measured when the alarm is generated and the pre-stored normal pattern if the probability that the alarm is the false alarm exceeds a third predetermined threshold value.

7. A method for detecting a false alarm, comprising:

receiving from a target for monitoring a measured value indicating a status of the target that is measured when an alarm is generated;

measuring non-similarity between the measured value that is measured when the alarm is generated and a pre-stored normal pattern indicating a normal alarm;

classifying the measured value into a first statistical pattern of pre-stored measured values related to a past false alarm based on a first statistical distance between the measured value and the first statistical pattern or a second statistical pattern of pre-stored measured values related to a past normal alarm based on a second statistical distance between the measured value and the second statistical pattern if the non-similarity exceeds a first predetermined threshold value; and outputting the alarm if the measured value that is measured when the alarm is generated is classified into the pre-stored measured values related to the past normal alarm.

8. The method of claim 7, wherein the measuring non-similarity between the measured value and the pre-stored normal pattern comprises updating the pre-stored normal pattern with the measured value that is measured when the alarm is generated if the non-similarity between the measure value and the pre-stored normal pattern is equal to or smaller than the first predetermined threshold value.

9. The method of claim 7, wherein the classifying the measured value into the first statistical pattern of the pre-stored measured values related to the past false alarm or the second statistical pattern of the pre-stored measured values related to the past normal alarm comprises:

generating the first statistical pattern that is a statistical pattern of the pre-stored measured values related to the past false alarm and the second statistical pattern that is a statistical pattern of the pre-stored measured values related to the past normal alarm;

measuring the first statistical distance between the measured value that is measured when the alarm is generated and the first statistical pattern and the second statistical distance between the measured value that is measured when the alarm is generated and the second statistical pattern; and classifying the measured value that is measured when the alarm is generated so that the measured value belongs to the first statistical pattern or the second statistical pattern in accordance with the first measured statistical distance and the second measured statistical distance.

10. The method of claim 7, further comprising updating the pre-stored measured values related to the past false alarm if the non-similarity between the measured value that is measured when the alarm is generated and the first statistical pattern is equal to or smaller than the first predetermined threshold value.

11. The method of claim 10, wherein the updating the pre-stored measured values related to the past false alarm comprises updating the pre-stored measured values related to the past false alarm by reflecting the measured value that is measured when the alarm is generated in the pre-stored measured values related to the past false alarm.

12. The method of claim 7, wherein the measuring the non-similarity between the measured value that is measured when the alarm is generated and the pre-stored normal pattern comprises:

calculating a probability that the generated alarm is a false alarm; and measuring the non-similarity between the measured value that is measured when the alarm is generated and the pre-stored normal pattern if the probability that the alarm is the false alarm exceeds a second predetermined threshold value.

13. An apparatus for detecting a false alarm comprising:

a normal pattern comparison unit configured to measure non-similarity between a measured value indicating a status of a target that is measured once an alarm is generated in a target for monitoring and a pre-stored normal pattern;

a false alarm filtering unit configured to measure non-similarity between the measured value and a first statistical pattern of pre-stored measured values related to a past false alarm based on a first statistical distance between the measured value and the first statistical pattern if the non-similarity exceeding a first predetermined threshold value; and an alarm generation unit configured to provide the generated alarm to a user if the non-similarity between the measure value and the pre-stored related values related to the past false alarm exceeds a second predetermined threshold value.

14. The apparatus of claim 13, wherein the normal pattern comparison unit is further configured to update the pre-stored normal pattern with the measured value that is measured when the alarm is generated if the non-similarity between the measure value and the pre-stored normal pattern is equal to or smaller than the first predetermined threshold value.

15. The apparatus of claim 13, wherein the false alarm filtering unit is further configured to measure the first statistical distance between the first statistical pattern of the pre-stored measured values related to the past false alarm and the measured value measured when the alarm is generated, and to determine that the measured value that is measured when the alarm is generated is non-similar the first statistical pattern of to the pre-stored measured values related to the past false alarm if the first statistical distance is greater than a third predetermined threshold value.

16. The apparatus of claim 13, wherein the false alarm filtering unit is further configured to update the pre-stored measured values related to the past false alarm if the non-similarity between the measured value that is measured when the alarm is generated and the first statistical pattern is equal to or smaller than the second predetermined threshold value.

17. The apparatus of claim 13, further comprising a false alarm probability calculation unit configured to calculate a probability that the generated alarm is a false alarm, wherein the normal pattern comparison unit measures the non-similarity between the measured value that is measured when the alarm is generated and the pre-stored normal pattern if the probability that the alarm is the false alarm exceeds a third predetermined threshold value.

18. An apparatus for detecting a false alarm comprising:

a normal pattern comparison unit configured to measure non-similarity between a measured value indicating a status of a target that is measured once an alarm is generated in a target for monitoring and a pre-stored normal pattern;

a classification unit configured to classify the measured value into a first statistical pattern of pre-stored measured values related to a past false alarm based on a first statistical distance between the measured value and the first statistical pattern or a second statistical pattern of pre-stored measured values related to a past normal alarm based on a second statistical distance between the measured value and the second statistical pattern if a first non-similarity exceeds a first predetermined threshold value; and an alarm generation unit configured to output the alarm once the measured value that is measured when the alarm is generated is classified into the pre-stored measured values related to the past normal alarm.

19. The apparatus of claim 18, wherein the normal pattern comparison unit is further configured to update the pre-stored normal pattern with the measured value that is measured when the alarm is generated if the non-similarity between the measure value and the pre-stored normal pattern is equal to or smaller than the first predetermined threshold value.

20. The apparatus of claim 18, wherein the classification unit is further configured to measure the first statistical distance between the measured value that is measured when the alarm is generated and the first statistical pattern and the second statistical distance between the measured value that is measured when the alarm is generated and the second statistical pattern, and classifies the measured value that is measured when the alarm is generated so that the measured value belongs to the first statistical pattern or the second statistical pattern in accordance with the first measured statistical distance and the second measured statistical distance.

21. The apparatus of claim 18, wherein the classification unit is further configured to update the pre-stored measured values related to the past false alarm if the non-similarity between the measured value that is measured when the alarm is generated and the first statistical pattern is equal to or smaller than the first predetermined threshold value.

22. The apparatus of claim 18, further comprising a false alarm probability calculation unit configured to calculate a probability that the generated alarm is a false alarm, wherein the normal pattern comparison unit measures the non-similarity between the measured value that is measured when the alarm is generated and the pre-stored normal pattern if the probability that the alarm is the false alarm exceeds a second predetermined threshold value.

* * * * *